United States Patent [19]

Bruce

[11] Patent Number: 4,851,077

[45] Date of Patent: Jul. 25, 1989

[54] CHEMICAL MILLING OF LITHIUM ALUMINUM ALLOY

[75] Inventor: Leland E. Bruce, Huntington Beach, Calif.

[73] Assignee: McDonnell Douglas Corporation, Long Beach, Calif.

[21] Appl. No.: 195,792

[22] Filed: May 19, 1988

[51] Int. Cl.[4] ..... C23F 1/00; B44C 1/22

[52] U.S. Cl. ..... 156/626; 156/665; 252/79.3

[58] Field of Search ..... 156/626, 639, 640, 654, 156/664, 665; 252/79.2, 79.3

[56] References Cited

U.S. PATENT DOCUMENTS

| | | | |
|---|---|---|---|
| 2,867,514 | 1/1959 | Newhard et al. | 156/665 |
| 2,883,311 | 4/1959 | Halpert | 156/665 X |
| 2,904,413 | 9/1959 | Hampel | 252/79.3 |
| 3,346,128 | 10/1967 | Hullhorst | 214/6 |
| 3,905,907 | 9/1975 | Shiga | 252/79.4 |
| 3,954,645 | 5/1976 | Otrhaled et al. | 252/101 |
| 4,230,522 | 10/1980 | Martin et al. | 156/638 |
| 4,257,854 | 3/1981 | Daenen et al. | 204/36 |
| 4,477,290 | 10/1984 | Carroll et al. | 148/6 |
| 4,563,238 | 1/1986 | Rhoades | 156/637 |

*Primary Examiner*—William A. Powell

*Attorney, Agent, or Firm*—Curt L. Harrington; George W. Finch; John P. Scholl

[57] ABSTRACT

A chemical milling solution for lithium aluminum alloy is disclosed for manufacturing a surface finish having superior smoothness characteristics. The process is especially useful where material reduction or thinning is required wherein machining would otherwise be impossible or too expensive.

14 Claims, No Drawings

CHEMICAL MILLING OF LITHIUM ALUMINUM ALLOY

The government has rights in this invention pursuant to Contract No. F33657-81-C-2108 awarded by the Department of the Air Force.

BACKGROUND OF THE INVENTION

Lithium aluminum extruded alloys for utilization in the aerospace industry are available with the proper structural orientation and surface characteristics, but wherein the alloy is too thick requiring reduction in weight of the alloy. This is due to the fact that many extruded shapes cannot be manufactured as thin-walled extrusions. Those shapes which, due to their shape, must be extruded with a minimum thickness must subsequently be thinned.

Alloys other than lithium-aluminum have been successfully chemically milled. However, in the case of lithium-aluminum alloy, previous efforts at chemical milling have produced surface finishes which are unacceptable.

Surface roughness of metallic parts can be measured using a "roughness height rating" or RHR scale. RHR is an arithmetical average in microinches of the surface deviations from absolute smoothness. Standards in the aerospace industry dictate that the surface roughness of the lithium aluminum metal have a roughness height rating RHR of from less than 250 to 125.

Standard chemical milling processes in the aerospace industry for lithium aluminum alloy use a solution containing from 10% to 25% NaOH in water along with from 2 to 6 ounces elemental sulphur per gallon of the water - NaOH mixture. The mixture is heated to from 190 to 200 degrees Fahrenheit. This unsuccessful chemical milling mixture will produce a surface having a roughness height rating of not less than 500. Mechanical methods for producing a satisfactory surface roughness after such unsuccessful chemical milling to this reduced roughness standard are cost prohibitive.

SUMMARY OF THE INVENTION

The chemical milling solution of the present invention has produced a surface of satisfactory roughness having a roughness height rating of from 40 to 61. The process has been successfully practiced upon alloy 2090-T8ES1, a lithium aluminum extrusion. The process is also useful for reducing the thickness of the metal as desired and performs the reaction at room temperature. Chemical milling practiced using the solution of the present invention requires no heat, and desmutting of the metal surface is not required.

DETAILED DESCRIPTION OF THE PREFERRED EMBODIMENTS

Alloy 2090-T8ES1, upon which the invention has been successfully practiced, has the following composition:

| Component | Composition in alloy |
|---|---|
| Lithium | 1.5-3.5% |
| Magnesium | 6.% |
| Manganese | 1.% |
| Aluminum | 91.5-89.5% |

The solution used to successfully chemical mill the Lithium Aluminum extrusion described above is as follows:

| Component | Composition in solution |
|---|---|
| Nitric Acid | 8.9% to 12.0% |
| Chromic Acid | 4.7% to 6.0% |
| Hydrofluoric Acid | approximately 1.0% |
| Water | 81.0% to 85.4% |

EXAMPLE

The surface dimensions of a sample of alloy 2090-T8ES1, a lithium aluminum extrusion, were measured and recorded. The sample was then suspended in a horizontal position within a tank containing the chemical milling solution of the present invention. The roughness of the starting material ranged from an RHR rating of 30 to 60. The lithium aluminum sample was horizontally positioned in a manner to cause the most severe gas entrapment for a worst case test. The sample was an elongate metal member having a flattened plate-like base bisected into a forward and rear portion along its length by a planar surface member attached to the elongate metal member at an angle along the metal member's center. The sample was measured each morning for three days. On the third day the test was concluded. At that time all pre measured points on the sample were again measured and recorded. The following results were obtained:

RESULTS

Immersion time—74.5 hours
Average metal removed per surface—0.028"
Chemical milling rate—0.00039" per hour
Surface roughness—40-61 RHR (cross grain)

Thickness readings, before and after chemical milling (sample results in mils at three points in each area)

| Base forward | | | | | |
|---|---|---|---|---|---|
| Leftmost section | | Center section | | Rightmost section | |
| Before | After | Before | After | Before | After |
| 349 | 288 | 347 | 287 | 345 | 290 |
| 345 | 285 | 340 | 285 | 337 | 283 |
| 340 | 283 | 343 | 284 | 342 | 287 |
| **Base rearward** | | | | | |
| Leftmost section | | Center section | | Rightmost section | |
| Before | After | Before | After | Before | After |
| 342 | 286 | 342 | 285 | 340 | 286 |
| 341 | 286 | 340 | 287 | 341 | 286 |
| 348 | 292 | 345 | 290 | 347 | 292 |
| **Attached member** | | | | | |
| Leftmost section | | Center section | | Rightmost section | |
| Before | After | Before | After | Before | After |
| 245 | 188 | 241 | 187 | 243 | 187 |
| 244 | 184 | 239 | 185 | 241 | 186 |
| 243 | 188 | 241 | 187 | 242 | 188 |

No other ingredients are required. During the chemical milling, the hydrofluoric acid is consumed in the reaction. Consequently, as the hydrofluoric acid is consumed, the etch rate will decrease. It is recommended to add hydrofluoric acid as needed to maintain a milling rate in the latter stages of chemical milling equivalent to about 50% of the initial milling rate. This step will assume greater or lesser importance depending upon the quantity and composition of the metal to be milled and the volume of solution in contact with the metal.

The foregoing was a description of a process for chemical milling of lithium aluminum alloy. The process results in a metal surface finish with superior smoothness characteristics. The process is also useful for controllably reducing the thickess of the metal. The rate of metal reduction can be readily controlled by controlling the strength of the hydrofluoric acid in the solution. The surface roughness reduction and reduction in thickness can, as recited in the example, be accomplished simultaneously. The chemical milling solution produces metal surfaces having a roughness height rating (RHR) of 40 to 61, and the surface of the metal after chemical milling does not require desmutting.

What is claimed is:

1. A chemical milling solution for lithium aluminum alloy comprising:

between about 8.9 to about 12.0 percent by volume nitric acid;

between about 4.7 to about 6.0 percent by volume Chromic Acid;

about 1.0 percent by volume Hydrofluoric Acid; and, between about 81.0 to about 85.4 percent by volume water.

2. The chemical milling solution of claim 1 wherein:

said nitric acid is 10 percent by volume;

said chromic acid is 5 percent by volume; and, said water is 84 percent by volume.

3. A method of producing a finish on the surface of a lithium aluminum alloy with a roughness height rating of less than 150, comprising:

exposure to a chemical milling solution comprising:

between about 8.9 to about 12.0 percent by volume nitric acid;

between about 4.7 to about 6.0 percent by volume chromic acid;

about 1.0 percent by volume Hydrofluoric Acid; and, between about 81.0 to about 85.4 percent by volume water.

4. The method as recited in claim 3 wherein said exposure of said lithium aluminum alloy to said chemical milling solution is by immersion of said lithium aluminum alloy within said chemical milling solution.

5. The method as recited in claim 4 further comprising the step of maintaining a sufficient amount of hydrofluoric acid in said chemical milling solution to control the chemical milling rate.

6. The method as recited in claim 5 where said maintaining step is performed to sustain the chemical milling rate to at least 50% of the initial chemical milling rate.

7. The method as recited in claim 3 wherein said exposure of said lithium aluminum alloy to said chemical milling solution is by spraying said lithium aluminum alloy with said chemical milling solution.

8. A process for chemical milling the surface of a lithium aluminum alloy workpiece comPrising the steps of:

exposing said lithium aluminum alloy workpiece to a chemical milling solution which reduces the surface roughness of said workpiece while reducing the mass of said workpiece;

monitoring periodically the thickness of said work piece in order to ascertain the extent of workpiece reduction which has taken place; and, removing said workpiece from exposure to said chemical milling solution when the thickness of said workpiece has been sufficiently reduced.

9. A process for chemical milling the surface of a lithium aluminum alloy workpiece comprising the steps of:

exposing said lithium aluminum alloy workpiece to a chemical milling solution which reduces the surface roughness of said workpiece while reducing the mass of said workpiece;

monitoring periodically the thickness of said work piece in order to ascertain the extent of surface roughness which has been reduced; and, removing said workpiece from exposure to said chemical milling solution when the roughness of said workpiece has been sufficiently reduced.

10. A process for chemical milling the surface of a lithium aluminum alloy comprising the steps of:

exposing a lithium aluminum alloy whose composition comprises:

about 1.5 to 3.5 percent by weight lithium;

about 6.0 percent by weight Magnesium;

about 1.0 percent by weight Manganese; and, about 91.5 to 89.5 percent by weight Aluminum;

to a chemical milling solution whose composition comprises:

between about 8.9 to about 12.0 percent by volume nitric acid;

between about 4.7 to about 6.0 percent by volume chromic acid;

about 1.0 percent by volume Hydrofluoric Acid; and, between about 81.0 to about 85.4 percent by volume water; and, ceasing said exposure of said lithium aluminum alloy to said chemical milling solution.

11. The process, as recited in claim 10 wherein said ceasing said exposure step is performed once the roughness of the surface of said lithium aluminum alloy is reduced to a prespecified level.

12. The process, as recited in claim 10 wherein said ceasing said exposure step is performed once the mass of said lithium aluminum alloy is reduced to a prespecified level.

13. The process, as recited in claim 10 wherein said ceasing said exposure step is performed once the surface depth of said lithium aluminum alloy is reduced to a prespecified level.

14. A chemical milling solution consisting essentially of:

between about 8.9 to about 12.0 percent by volume nitric acid;

between about 4.7 to about 6.0 percent by volume Chromic Acid;

about 1.0 percent by volume Hydrofluoric Acid; and, between about 81.0 to about 85.4 percent by volume water.

* * * * *